US008491336B2

(12) United States Patent
Cocquyt et al.

(10) Patent No.: US 8,491,336 B2
(45) **Date of Patent: *Jul. 23, 2013**

(54) WATERPROOF ELECTRICAL CONNECTOR AND SYSTEM

(75) Inventors: Jos B. Cocquyt, Venice, CA (US); Luke Bradley, Los Angeles, CA (US); Jeremy Tyler, Thousand Oaks, CA (US)

(73) Assignee: AeroVironment, Inc., Monrovia, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/555,398

(22) Filed: Jul. 23, 2012

(65) Prior Publication Data

US 2012/0289067 A1 Nov. 15, 2012

Related U.S. Application Data

(63) Continuation of application No. 13/194,991, filed on Jul. 31, 2011, now Pat. No. 8,257,113, which is a continuation of application No. 12/636,685, filed on Dec. 11, 2009, now Pat. No. 7,997,931.

(51) Int. Cl.
*H01R 13/40* (2006.01)

(52) U.S. Cl.
USPC ..... 439/587

(58) Field of Classification Search
USPC ..... 439/587, 589, 658, 685, 211
See application file for complete search history.

(56) References Cited

U.S. PATENT DOCUMENTS

| | | | | |
|---|---|---|---|---|
| 2,322,491 | A * | 6/1943 | Williams | 439/460 |
| 2,506,615 | A | 5/1950 | Rosen | |
| 3,685,004 | A * | 8/1972 | Kerr | 439/205 |
| 3,727,169 | A | 4/1973 | Crane et al. | |
| 3,836,935 | A * | 9/1974 | Johnson | 439/75 |
| 3,937,545 | A * | 2/1976 | Cairns et al. | 439/272 |
| 3,986,765 | A * | 10/1976 | Shaffer et al. | 439/314 |
| 4,012,093 | A | 3/1977 | Crane | |
| 4,193,655 | A * | 3/1980 | Herrmann, Jr. | 439/166 |
| 4,311,355 | A * | 1/1982 | Plyler et al. | 439/274 |
| 4,395,085 | A * | 7/1983 | Inoue | 439/271 |
| 4,523,798 | A * | 6/1985 | Barrows et al. | 439/685 |

(Continued)

FOREIGN PATENT DOCUMENTS

| | | |
|---|---|---|
| EP | 0 299 797 | 1/1989 |
| EP | 0 866 521 | 9/1998 |

(Continued)

OTHER PUBLICATIONS

USPTO Office Action of Dec. 13, 2011, U.S. Appl. No. 13/194,991, Title: Waterproof Electrical Connector and System, filed Jul. 31, 2011.

(Continued)

*Primary Examiner* — Briggitte R Hammond
*Assistant Examiner* — Vladimir Imas
(74) *Attorney, Agent, or Firm* — Christopher R. Balzan; Eric J. Aagaard

(57) ABSTRACT

In one possible embodiment, a waterproof connector is provided having pins secured to a bendable board. The bendable board and a portion of each of the pins are encased in a compressible material capable of providing a biasing force on the plurality of pins upon mating with a mating surface. The compressible material also provides a deformable sealing surface for mating with the mating surface.

29 Claims, 5 Drawing Sheets

U.S. PATENT DOCUMENTS

| | | | | |
|---|---|---|---|---|
| 4,611,872 | A * | 9/1986 | Ito et al. | 439/277 |
| 4,687,266 | A | 8/1987 | Tanii et al. | |
| 4,940,420 | A * | 7/1990 | Munie | 439/272 |
| 5,037,307 | A * | 8/1991 | Ogasawara | 439/34 |
| 5,112,241 | A * | 5/1992 | Chesnut et al. | 439/273 |
| 5,129,843 | A * | 7/1992 | Bowsky et al. | 439/685 |
| 5,131,858 | A * | 7/1992 | Heimbrock | 439/181 |
| 5,358,420 | A * | 10/1994 | Cairns et al. | 439/206 |
| 5,368,499 | A * | 11/1994 | Hirt | 439/350 |
| 5,490,785 | A * | 2/1996 | Hein et al. | 439/76.1 |
| 5,492,487 | A * | 2/1996 | Cairns et al. | 439/273 |
| 5,580,282 | A * | 12/1996 | Paterek | 439/685 |
| 5,584,716 | A * | 12/1996 | Bergman | 439/282 |
| 5,803,759 | A * | 9/1998 | Griffith et al. | 439/274 |
| 6,132,250 | A * | 10/2000 | Shinozaki et al. | 439/587 |
| 6,152,745 | A * | 11/2000 | Matsumoto et al. | 439/98 |
| 6,165,013 | A * | 12/2000 | Broussard | 439/606 |
| 6,257,928 | B1 * | 7/2001 | Murakami et al. | 439/587 |
| 6,302,734 | B1 * | 10/2001 | Ichio et al. | 439/587 |
| 6,305,989 | B1 * | 10/2001 | Quadir | 439/685 |
| 6,343,953 | B2 * | 2/2002 | Nakamura et al. | 439/589 |
| 6,383,013 | B1 * | 5/2002 | Ghesla et al. | 439/417 |
| 6,402,552 | B1 * | 6/2002 | Wagner | 439/606 |
| 6,482,021 | B2 * | 11/2002 | Hara et al. | 439/279 |
| 6,485,334 | B2 * | 11/2002 | Hattori et al. | 439/604 |
| 6,494,731 | B1 * | 12/2002 | Suzuki | 439/275 |
| 6,500,027 | B1 * | 12/2002 | Van Der Sanden et al. | 439/587 |
| 6,520,788 | B2 * | 2/2003 | Ichida et al. | 439/271 |
| 6,616,480 | B2 * | 9/2003 | Kameyama | 439/587 |
| 6,632,104 | B2 * | 10/2003 | Quadir | 439/587 |
| 6,699,078 | B2 * | 3/2004 | Quadir | 439/693 |
| 6,722,922 | B2 * | 4/2004 | Cykon et al. | 439/587 |
| 6,752,646 | B2 * | 6/2004 | McCoy | 439/367 |
| 6,827,615 | B2 * | 12/2004 | Axelsson | 439/885 |
| 6,837,744 | B2 * | 1/2005 | To et al. | 439/587 |
| 7,014,502 | B2 * | 3/2006 | Rasmussen | 439/578 |
| 7,070,449 | B2 * | 7/2006 | Miyazaki | 439/587 |
| 7,094,104 | B1 * | 8/2006 | Burke et al. | 439/620.01 |
| 7,210,966 | B2 * | 5/2007 | Taylor et al. | 439/620.09 |
| 7,241,178 | B2 * | 7/2007 | Schaffner | 439/660 |
| 7,273,395 | B2 * | 9/2007 | Hayashi | 439/587 |
| 7,275,958 | B2 * | 10/2007 | Unruh | 439/587 |
| 7,335,067 | B2 | 2/2008 | Lee et al. | |
| 7,341,484 | B2 * | 3/2008 | Yamamoto | 439/587 |
| 7,347,723 | B1 | 3/2008 | Daily | |
| 7,347,731 | B1 * | 3/2008 | Gilmore et al. | 439/587 |
| 7,351,102 | B2 * | 4/2008 | Cykon et al. | 439/587 |
| 7,370,413 | B2 * | 5/2008 | Perle et al. | 29/858 |
| 7,448,894 | B2 * | 11/2008 | Tsuji et al. | 439/271 |
| 7,481,674 | B2 * | 1/2009 | Murakami et al. | 439/587 |
| 7,530,843 | B1 * | 5/2009 | Tesfay et al. | 439/587 |
| 2001/0025964 | A1 | 10/2001 | Loddenkotter et al. | |
| 2002/0006747 | A1 * | 1/2002 | Yuasa et al. | 439/587 |
| 2002/0052142 | A1 * | 5/2002 | Ishikawa et al. | 439/587 |
| 2002/0142627 | A1 | 10/2002 | Kameyama | |
| 2003/0157831 | A1 * | 8/2003 | Quadir | 439/587 |
| 2003/0176105 | A1 * | 9/2003 | To et al. | 439/587 |
| 2003/0176106 | A1 * | 9/2003 | To | 439/587 |
| 2003/0186585 | A1 * | 10/2003 | Cykon et al. | 439/587 |
| 2004/0029443 | A1 * | 2/2004 | Quadir et al. | 439/587 |
| 2005/0101185 | A1 * | 5/2005 | Gensert et al. | 439/587 |
| 2006/0178049 | A1 * | 8/2006 | Ishikawa | 439/587 |
| 2006/0194476 | A1 * | 8/2006 | Garrett et al. | 439/587 |
| 2006/0240710 | A1 * | 10/2006 | Kato et al. | 439/587 |
| 2007/0020996 | A1 * | 1/2007 | Kurzeja | 439/587 |
| 2007/0167083 | A1 | 7/2007 | Mineo | |
| 2008/0188119 | A1 * | 8/2008 | Okamura et al. | 439/445 |

FOREIGN PATENT DOCUMENTS

| | | |
|---|---|---|
| EP | 1 119078 | 7/2001 |
| GB | 967325 | 8/1964 |
| GB | 967326 | 8/1964 |
| GB | 1005923 | 9/1965 |
| JP | 4-199786 | 7/1992 |
| JP | 10-69939 | 3/1998 |
| JP | 11-121129 | 4/1999 |
| JP | 11-167946 | 6/1999 |
| WO | WO2008/039616 | 4/2008 |

OTHER PUBLICATIONS

USPTO Notice of Allowance mailed May 1, 2012, U.S. Appl. No. 13/194,991, Title: Waterproof Electrical Connector and System, filed Jul. 31, 2011.

* cited by examiner

WATERPROOF ELECTRICAL CONNECTOR AND SYSTEM

CROSS REFERENCE TO RELATED APPLICATION

The following application is a continuation of U.S. patent application Ser. No. 13/194,991, filed Jul. 31, 2011, by Cocquyt et al., entitled WATERPROOF ELECTRICAL CONNECTOR AND SYSTEM, which is a continuation of U.S. Pat. No. 7,997,931, by Cocquyt et al., entitled WATERPROOF ELECTRICAL CONNECTOR AND SYSTEM, issued Aug. 16, 2011, both herein incorporated by reference in their entireties.

BACKGROUND

Reducing weight and size are paramount in the design of small unmanned vehicles. Such vehicles are now being sought that can operate while being exposed to, or after being exposed to aquatic environments. For example, it may be preferred to land an unmanned aerial vehicle on water, rather than on land, either to lessen the impact of landing, or because it is a more easily retrievable location. Conventional connectors are either not completely waterproof, not suited for total submersion, will not function if water is introduced, are susceptible to failure if corrosion is present, or are too bulky and/or heavy. Furthermore, conventional waterproof connectors are often designed for extended use, which is not always required for expendable small unmanned vehicles. Therefore, conventional waterproof connectors also can be too expensive to fabricate.

Want is needed is a light weight, robust, inexpensive waterproof connector suited for harsh aquatic environments. Also, what is needed is an efficient, light weight system integrating a waterproof connector into the structure of a lightweight vehicle. Further, what is needed is a blind mate connector that can operate without shorting even if water is introduced.

SUMMARY

In one possible embodiment, a waterproof connector is provided having pins secured to a bendable board. The bendable board and a portion of each of the pins are encased in a compressible material capable of providing a biasing force on the plurality of pins upon mating with a mating surface. The compressible material also further provides a deformable sealing surface for mating with the mating surface.

In another possible embodiment, a waterproof connector is provided having a plurality of pins secured to a board comprising a flexible material. A compressible material encases the flexible material board and a portion of each of the plurality of the pins. The compressible material is located behind ends of the plurality of pins opposite mating surface ends of the plurality of pins so as to be capable of providing a biasing force on the plurality of pins upon mating with a mating surface. The compressible material forms a deformable sealing surface for mating with the mating surface.

BRIEF DESCRIPTION OF THE DRAWINGS

The features and advantages of the present invention will be better understood with regard to the following description, appended claims, and accompanying drawings where:

DESCRIPTION

Figure 1A:
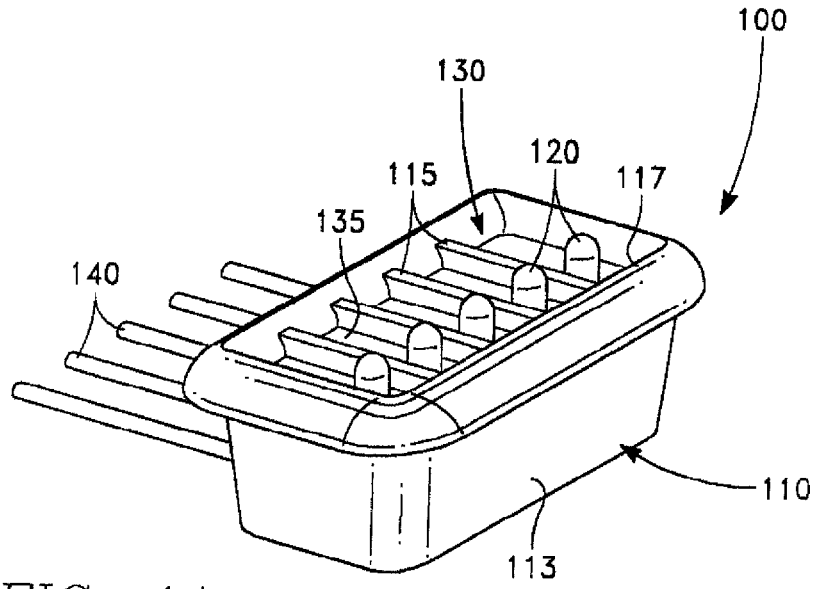
FIG. 1A shows a perspective view of a back of an embodiment of a waterproof connector.
Figure 1B:
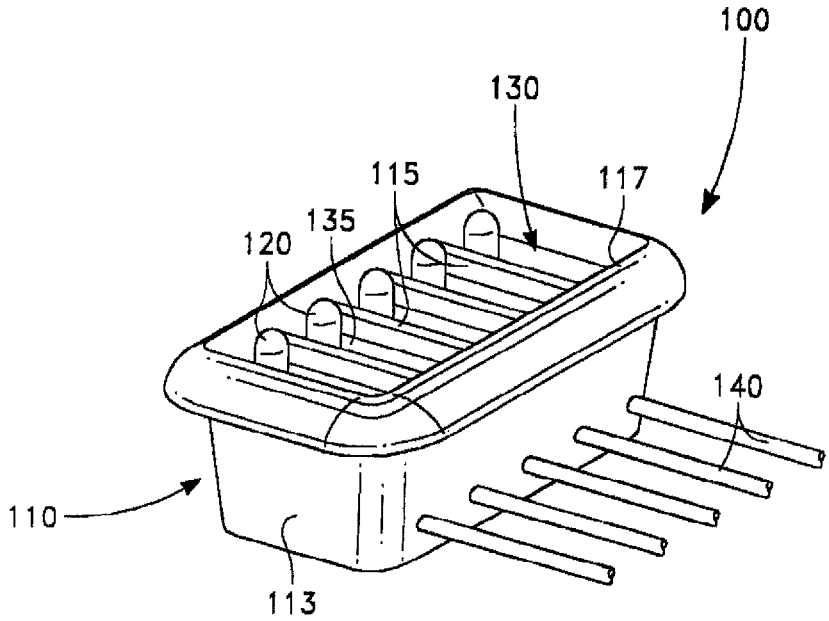
FIG. 1B shows a perspective view of a front of an embodiment of a waterproof connector.

FIGS. 1A and 1B show perspective views of an embodiment of a waterproof connector 100. The waterproof connector 100 has a unitary compressible housing 110, which partially encapsulates and holds electrical contact pins 120. The compressible housing 110 may be made of a resilient compressible material, such as silicone. The pins 120 each have a portion extending from the housing into a well 130 formed by the housing 110. Lead lines 140 extend into the base 113 of the unitary housing 110 and couple with the pins 120 within the base 113 of the unitary housing 110. The base 113 surrounds the lead lines 140 to inhibit seepage of water into the base 113 by way of the lead lines 140.

The housing 110 has a sealing lip 117 around the well 130 at a mating interface of the waterproof connector 100. The unitary housing 110 forms partitions 115, extending vertically from the base 113 into the well 130 toward the sealing lip 117 between the electrical contact pins 120. The partitions 115 are flexible, and form separate cavities 135 which isolate any water (not shown) that happens to enter the well 130 within the cavities 135. This compartmentalizing of the water within the connector 100, results in keeping any water that is adjacent to or contacting a pin from being in electrical communication with any other water contacting another pin, inhibiting short circuiting between the pins 120.

Figure 5:
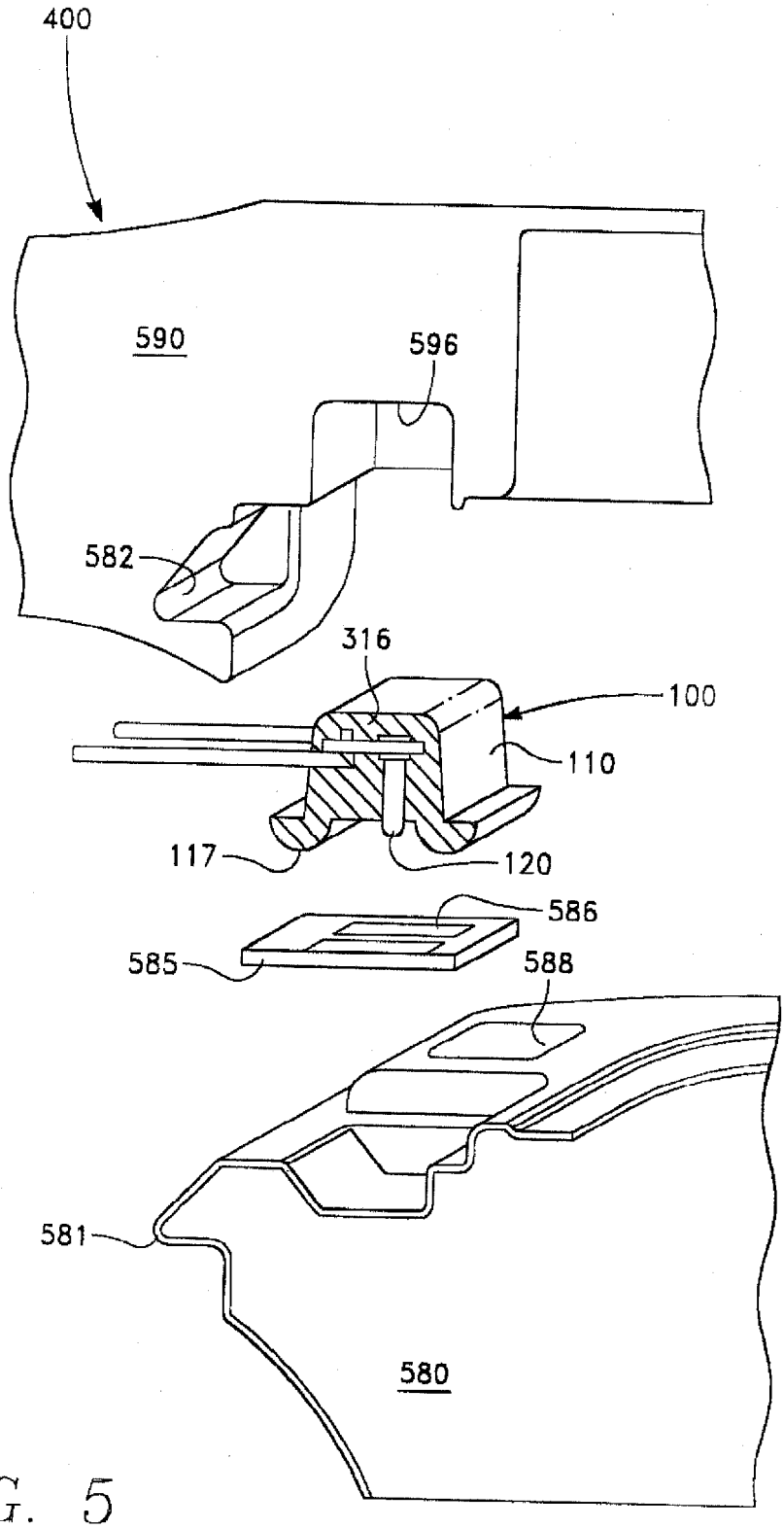
FIG. 5 shows an exploded projected view illustrating one possible system employing an embodiment of the waterproof connector and a payload for mating with the vehicle of FIG. 4.

In some applications, a battery is installed prior to mating the waterproof connector 110 with a payload 580 (FIG. 5). Thus, one or more of the pins 120 may be powered during to mating. Compartmentalizing any water droplets that may be present in the well 130 inhibits shorting of a powered pin.

Figure 2:
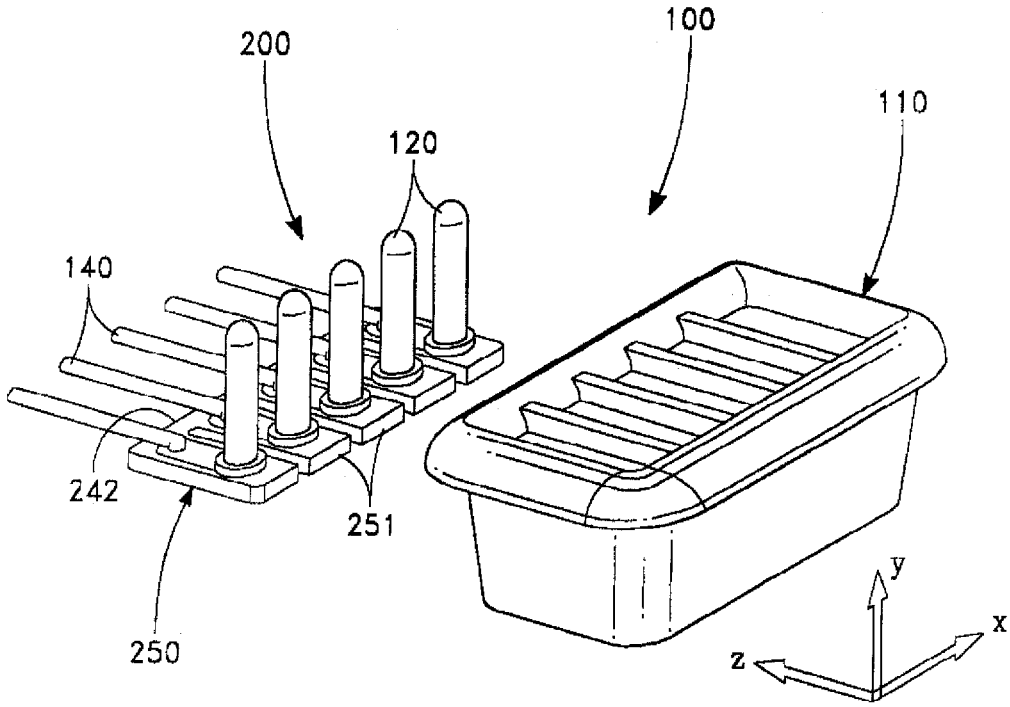
FIG. 2 shows an exploded perspective view of the waterproof connector.

FIG. 2 shows an exploded perspective view of the waterproof connector 100. A finger board assembly 200 is shown outside of the housing 110. As shown in FIGS. 1A and 1B, when assembled, the finger board assembly 200 is within the housing 110. The pins 120 are secured to a finger board 250, such as by swaging into the finger board 250. The pins 120 and the lead lines 140 may both be soldered (not shown) to the finger board 250. The pins 120 and their corresponding lead lines 140 may be electrically connected together by the solder, or via traces (not shown) within, or on the surface of the finger board 250.

The finger board 250 is a unitary board fabricated out of a flexible material, such as a printed circuit board, fiberglass, or the like. The finger board 250 has separate projecting fingers 251, attached together near a lead line side 242 of the finger board 250 so that the individual pins 120 are able to independently move in 2-axis, side-to-side/up-and-back, and up and down. Thus, the fingers 251 allow both torsional movement, and flex, along the longitudinal axis.

Figure 3:
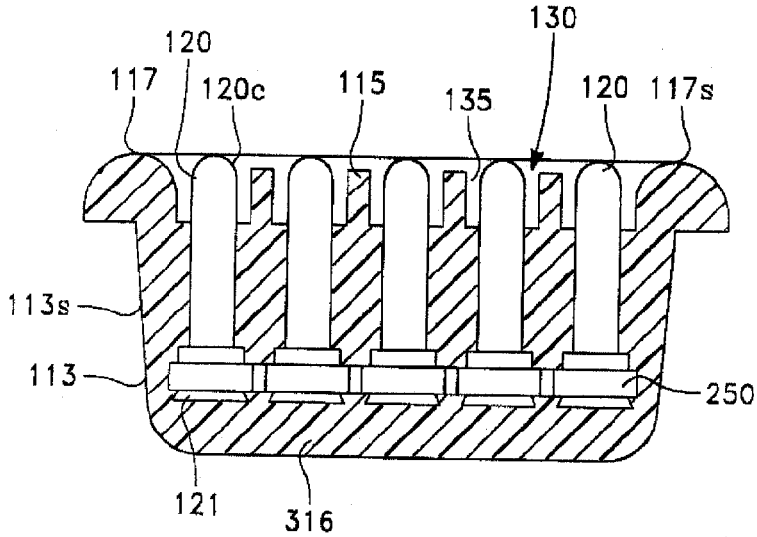
FIG. 3 is a cut-away front view of the waterproof connector of FIGS. 1A and 1B.

FIG. 3 is a cut-away front view of the waterproof connector 100 of FIGS. 1A and 1B. The finger board 250 is encased within the base 113, with the pins 120 extending from the base 113 into the well 130. Partitions 115 extend from the base 113 into the well 130 between the pins 120. A portion of the base 113 forms a compressible backing 316 under the finger board 250 opposite the mating interface. The compressible backing 316 resiliently supports the finger board 250 and the base 121 of the pins 120 when backed by a supporting structure. The compressible backing 316 provides a biasing force against the pins 120 when compressed. In some embodiments, the pins 120 may extend above a top sealing surface 117*s* of the sealing lip 117 prior to mating, and have a chamfered contact surface 120*c* to allow sliding of the pin over a contact pad 586 (FIG. 5).

In the embodiment of FIG. 3, the sealing lip 117 is semicircular in cross section and overhangs the side wall 113*s* of the base 113. The partitions 115 extend to, or slightly below the sealing surface 117*s* of the sealing lip 117. Thus, in some embodiments, when the sealing lip 117 is compressed against a mating surface (shown in FIG. 5), the partitions 115 meet to seal against the mating surface, such as a contact board (shown in FIG. 5). In other embodiments, the partitions 115 need not actually contact the mating surface (shown in FIG. 5) and completely enclose the cavities 135 to be effective. The partitions 115 may provide a fluid barrier when oriented such that the fluid is contained within the well 130 near the base 113 by gravity and thus is separated by the partitions 115. In such an embodiment, the partitions 115 will inhibit short circuiting between adjacent pins until the level of the fluid within the well 130, or within adjacent cavities 135, exceeds the height of the partitions 115. Further, the partitions 115 inhibit shorting when the connector 100 is unmated. This is particularly important if the connector could have power on any of the pins 120 prior to mating.

Figure 4:
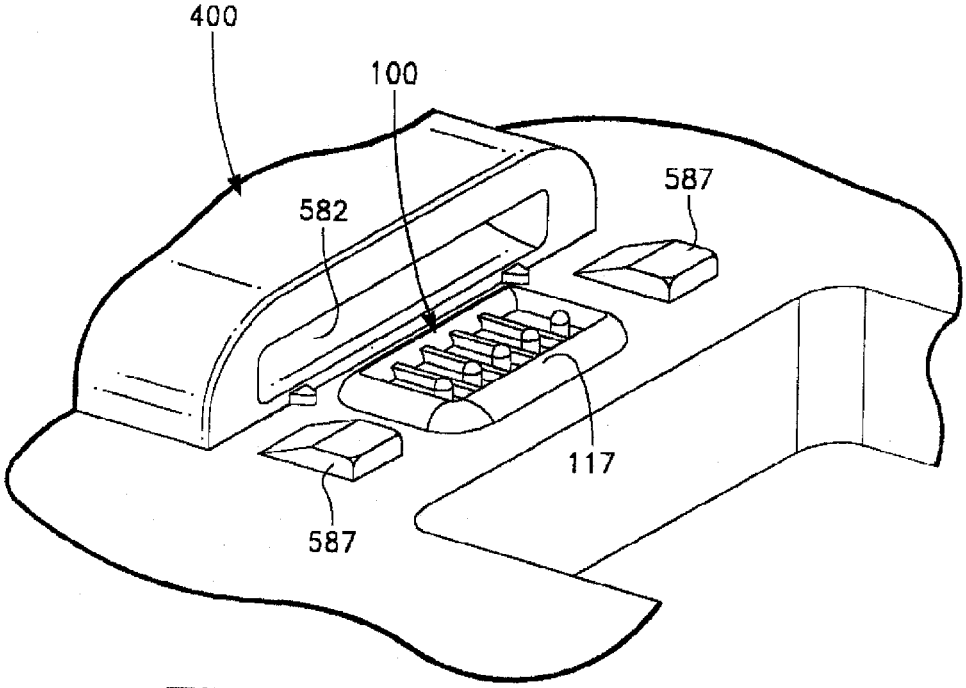
FIG. 4 shows a projected view of an embodiment of the waterproof connector installed in a vehicle.

FIG. 4 shows a projected view of an embodiment of the waterproof connector 100 installed in a vehicle 400. The vehicle 400, which provides a rigid backing for the base (not shown in FIG. 4) and for the sealing lip 117 of the waterproof connector 100. Thus, the waterproof connector 100 is integrated into the structural frame of vehicle 400 and may be secured within the frame of the vehicle 400 by glue, interference fit, etc.

Figure 6:
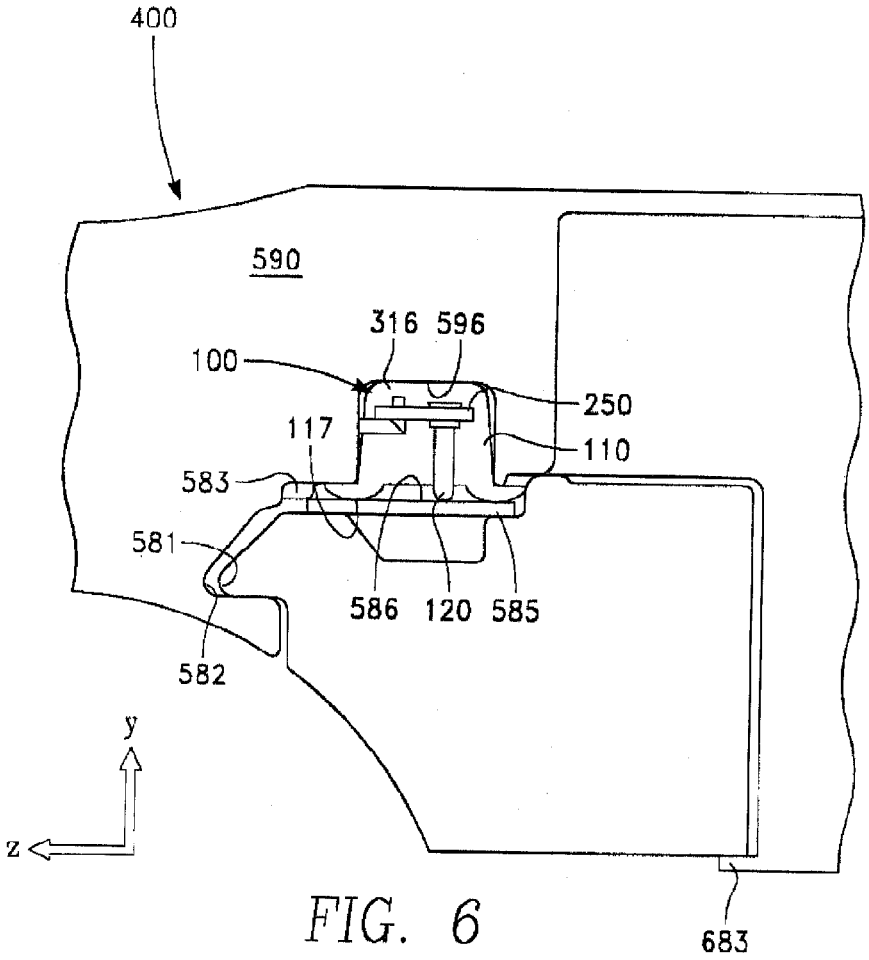
FIG. 6 shows a cross sectional side view of the embodiment of FIG. 5.

FIG. 5 shows an exploded projected view illustrating one possible system employing an embodiment of the waterproof connector 100 a payload 580 for mating with the vehicle 400 of FIG. 4. FIG. 6 shows a cross sectional side view of the embodiment of FIG. 5. Referring to FIGS. 5 and 6, the waterproof connector 100 seats within a rigid housing 590. The compressible backing 316 of the compressible housing 110 seats against the rigid backing 596, which provides a supporting structure for the compressible backing 316.

In this embodiment, the rigid housing 590 is part of the structural component of the vehicle 400. Thus, the rigid housing 590 is integrated into the structural frame of the vehicle 400. This provides a weight and space savings, as compared to conventional connectors with separate hard shells, while still providing a robust waterproof connector.

The waterproof connector 100 mates with a contact board 585 seated in the payload 580. A projection 581 on the payload 580 is inserted into receptacle 582, the payload 580 is pivoted about the projection 581 in the receptacle 582 to cause the contact board 585 to mate with connector 100 seated in the rigid housing 590. Optional alignment slots 588 and alignment projections 587 (FIG. 4) facilitate mating of the payload 580 with the vehicle 400. The mating of the contact board 585 with the waterproof connector 100 causes the pins 120 to engage contact pads 586 on the contact board 585. In some embodiments (not shown), the contact pads 586 may contain dimples for receiving the pins 120 and/or to keep the pins 120 in alignment upon mating. In other embodiments, the pins 120 may be inserted into receptacles (not show), or other means, that engage the pins 120.

One advantage of the unitary housing, which incorporates the sealing surface 117 as an integral part of the housing 110 is that it ensures that the sealing lip 117 is not displaced during the mating process. The pivotal mating by rotating the board 585 to mate with the connector 100 could otherwise cause a conventional gasket to slide or unseat during the mating process, compromising the waterproof seal.

The compressible backing 316 backed by rigid backing 596, along with the flexible finger board 250, biases the pins 120 against the contact pads 586. The rigid housing 590 biases the sealing lip 117 to form a face seal against the contact board 585 (or other sealing surface associated with the payload 580) to seal pins 120 within the compressible housing 110. A locking means 683 distal from the projection 581, in cooperation with the projection 581 secures the payload 580 to the vehicle 400 and maintains contact of the pins 120 with the contact pads 586, and the sealing lip 117 with the contact board 585, and the partitions 115 (FIG. 3) with the contact board 585 if applicable.

One advantage of allowing the pins 120 to move along the contact pads 586 as they meet the contact board 585, is that they can abrade the contact board 585 as the connector 100 is seated against the contact board 585. Thus, in some embodiments, the pins 120 are able to scrape through surface oxidation on the contact pads 586 to make better electrical contact than a fixed pin configuration. In some embodiments, the pins 120 and/or the pads 586, may have abrading surfaces (not shown) to aid in the removal of oxidation from the pads 586 and/or the pins 120. Further, resiliently holding the pins 120, and allowing a limited degree of rotational movement of the pins 120, provides a lateral bias force on the pins 120 against the contact pads 586. The lateral bias is provided by a combination of the deflection of the finger board 250 and compression of the portions of the base 113 adjacent to the pins 120. This adds to the normal force provided by the compressible backing 316 against the back of the pins 120, to further improve contact between the pins 120 and the contact pads 586.

Figure 7A:
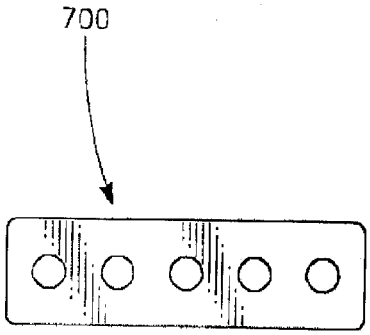
FIGS. 7A and 7B show a top view and a cross sectional side view of an optional guide plate.
Figure 7B:
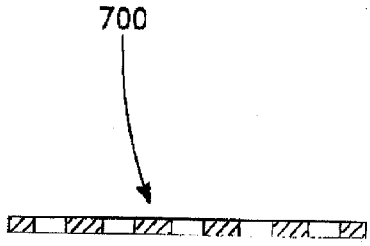

FIGS. 7A and 7B show a top view and a cross sectional side view, respectively, of an optional guide plate 700. The optional guide plate 700 may be placed over/around the pins 120 within the housing 113 to facilitate alignment of the pins 120 with the pads 586 on the contact board 585. Also, the guide plate 700 can inhibit individual side-to-side movement the pins 120 separately, to maintain separation between the pins 120 upon mating. The guide plate 700 may be situated on top of the partitions 115 and the lip 117. The guide plate 700 may be fabricated of a rigid material, such as fiberglass or other insulative material.

In various embodiments, the waterproof connector, is a light weight waterproof connector for a light weight UAV or unmanned aerial vehicle, which may have a payload such as electronics, a camera, battery, or other payload. The light weight waterproof connector 100 allows an easily portable unmanned aerial vehicle, which may be submersed in water, such as during transport, or upon landing. In some embodiments, it further allows separate subcomponents to be submersed during transport prior to assembly and operation, as some amount of liquid within the isolated cavities of the connector will not create shorting between the pins.

It is worthy to note that any reference to "one embodiment" or "an embodiment" or a "system" means that a particular feature, structure, or characteristic described in connection with the embodiment or system may be included in an embodiment or system, if desired. The appearances of the phrase "in one embodiment" in various places in the specification are not necessarily all referring to the same embodiment.

The illustrations and examples provided herein are for explanatory purposes and are not intended to limit the scope of the appended claims. This disclosure is to be considered an exemplification of the principles of the invention and is not intended to limit the spirit and scope of the invention and/or claims of the embodiment illustrated. Those skilled in the art will make modifications to the invention for particular applications of the invention.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

Having described this invention in connection with a number of embodiments, modification will now certainly suggest itself to those skilled in the art. The example embodiments herein are not intended to be limiting, various configurations and combinations of features are possible. As such, the invention is not limited to the disclosed embodiments, except as required by the appended claims.

What is claimed is:

1. A waterproof connector comprising:

a) a plurality of pins secured to a bendable board capable of bending;

b) the bendable board and a portion of each of the plurality of pins being encased in a compressible material capable of providing a biasing force on the plurality of pins against a mating surface of a contact board upon mating with the mating surface; and c) wherein the compressible material provides a deformable sealing surface for mating with the mating surface of the contact board.

2. The waterproof connector of claim 1, wherein the compressible material encases the bendable board such that the compressible material provides a biasing force upon the bendable board when the waterproof connector is seated within a structural housing and mated with the mating surface.

3. The waterproof connector of claim 1, wherein the compressible material is located behind distal ends of the plurality of pins opposite the sealing surface so as to provide a biasing force upon each of the plurality of pins toward the mating surface when the waterproof connector is seated within a structural housing and mated with the mating surface.

4. The waterproof connector of claim 3, wherein the compressible material encases a portion of each of the plurality of pins such that the compressible material biases each of the plurality of pins against lateral movement when the waterproof connector is seated within the structural housing and mated with the mating surface.

5. The waterproof connector of claim 1 further comprising a guide plate surrounding the plurality of pins.

6. The waterproof connector of claim 1, wherein the waterproof connector further comprises a structural housing, the compressible material is seated within the structural housing.

7. The waterproof connector of claim 6, wherein the structural housing comprises a recessed portion in a structural member of an apparatus.

8. The waterproof connector of claim 1, wherein the compressible material forms a well portion, the plurality of pins extending into the well portion.

9. The waterproof connector of claim 8 further comprising a plurality of partition portions within the well portion between the plurality of pins.

10. The waterproof connector of claim 9 further comprising a sealing lip portion along the well portion at a mating side of the waterproof connector.

11. The waterproof connector of claim 1, wherein the bendable board comprises a non-metallic material.

12. The waterproof connector of claim 11, wherein the bendable board comprises a printed circuit board.

13. The waterproof connector of claim 11, wherein the bendable board comprises a fiberglass material.

14. A waterproof connector comprising:

a) a plurality of pins secured to a board comprising a flexible material;

b) a compressible material encasing the flexible material board and a portion of each of the plurality of pins;

c) the compressible material being located behind distal ends of the plurality of pins opposite mating surface ends of the plurality of pins such that the compressible material caps the distal ends so as to be capable of providing a biasing force directly against the distal ends of the plurality of pins upon mating with a mating surface; and d) wherein the compressible material forms a deformable sealing surface for mating with the mating surface.

15. The waterproof connector of claim 14, wherein the compressible material encases the flexible material board such that the compressible material provides a biasing force upon the flexible material board when the waterproof connector is seated within a structural housing and mated with the mating surface.

16. The waterproof connector of claim 14, wherein the compressible material is located behind the distal ends of the plurality of pins opposite the sealing surface so as to provide a biasing force upon each of the plurality of pins toward the mating surface when the waterproof connector is seated within a structural housing and mated with the mating surface.

17. The waterproof connector of claim 16, wherein the compressible material encases a portion of each of the plurality of pins such that the compressible material biases each of the plurality of pins against lateral movement when the waterproof connector is seated within the structural housing and mated with the mating surface.

18. The waterproof connector of claim 14 further comprising a guide plate surrounding the plurality of pins.

19. The waterproof connector of claim 14, wherein the waterproof connector further comprises a structural housing, the compressible material is seated within the structural housing.

20. The waterproof connector of claim 19, wherein the structural housing comprises a recessed portion in a structural member of an apparatus.

21. The waterproof connector of claim 14, wherein the compressible material forms a well portion, the plurality of pins extending into the well portion.

22. The waterproof connector of claim 21 further comprising a plurality of partition portions within the well portion between the plurality of pins.

23. The waterproof connector of claim 22 further comprising a sealing lip portion along the well portion at a mating side of the waterproof connector.

24. The waterproof connector of claim 21 further comprising a sealing lip portion along the well portion at a mating side of the waterproof connector.

25. The waterproof connector of claim 14, wherein the flexible material board comprises a non-metallic material.

26. The waterproof connector of claim 25, wherein the flexible material board comprises a printed circuit board.

27. The waterproof connector of claim 25, wherein the flexible material board comprises a fiberglass material.

28. The waterproof connector of claim 1, wherein the compressible material provides a deformable sealing surface such that upon mating with the contact board, the deformable sealing surface seals with the mating surface to form a perimeter seal enclosing the plurality of pins within.

29. The waterproof connector of claim 14, wherein the compressible material provides a deformable sealing surface such that upon mating with the mating surface, the deformable sealing surface seals with the mating surface to form a perimeter seal enclosing the plurality of pins within.

* * * * *